US007726243B2

(12) United States Patent
Richards et al.

(10) Patent No.: US 7,726,243 B2
(45) Date of Patent: Jun. 1, 2010

(54) IGNITER SAFE AND ARM, IGNITER ASSEMBLY AND FLARE SO EQUIPPED AND METHOD OF PROVIDING A SAFETY FOR AN IGNITER ASSEMBLY

(75) Inventors: Kevin W. Richards, Mantua, UT (US); Kendall Dye, Ogden, UT (US); Robert G. Jones, Ogden, UT (US)

(73) Assignee: Alliant Techsystems Inc., Edina, MN (US)

( * ) Notice: Subject to any disclaimer, the term of this patent is extended or adjusted under 35 U.S.C. 154(b) by 849 days.

(21) Appl. No.: 11/559,867

(22) Filed: Nov. 14, 2006

(65) Prior Publication Data

US 2008/0110364 A1 May 15, 2008

(51) Int. Cl.
*F42C 15/34* (2006.01)
*F42C 15/184* (2006.01)

(52) U.S. Cl. ..... 102/254; 102/337; 102/258; 102/202.1; 89/1.55

(58) Field of Classification Search ..... 102/337, 102/338, 489, 254, 256, 258, 202.1; 89/1.55
See application file for complete search history.

(56) References Cited

U.S. PATENT DOCUMENTS 3,736,877 A 6/1973 Roberts et al.
4,029,014 A 6/1977 Cunningham
4,155,306 A 5/1979 Herold et al.
4,454,816 A 6/1984 Billard et al.
4,667,600 A 5/1987 Jensen et al.
5,386,781 A 2/1995 Day
6,412,417 B1 7/2002 Anderson et al.
6,588,343 B1 7/2003 Mulinix
6,679,174 B1 * 1/2004 Mulinix ..... 102/259

* cited by examiner

*Primary Examiner*—James S Bergin
(74) *Attorney, Agent, or Firm*—TraskBritt

(57) ABSTRACT

A parachute flare igniter assembly includes a novel safety for arresting the motion of a slider when subjected to external forces, but allows slider motion when subjected to intended cable actuation forces. The igniter safety includes a housing, a slider, a cable and a sleeve. The slider, connected to the cable, is slidably received within the housing. The cable moves the slider by applying a cable force conventionally obtained by actuation of a parachute associated with the flare and connected to an end of the cable opposite an end connected to the slider. The sleeve is connected to the cable and is disposed between the housing and the slider, so that the sleeve will arrest the slider with respect to the housing when the cable force is not present. A flare and a method of providing a safety in an igniter assembly is also provided.

32 Claims, 11 Drawing Sheets

IGNITER SAFE AND ARM, IGNITER ASSEMBLY AND FLARE SO EQUIPPED AND METHOD OF PROVIDING A SAFETY FOR AN IGNITER ASSEMBLY

This invention was made with Government support to Contract Numbers W52P1J-04-C-0002 and FA8213-04-C-0026. The Government has certain rights in this invention.

FIELD OF THE INVENTION

This invention, in various embodiments, relates to a novel igniter assembly for igniting combustible compositions in a highly reliable manner and, in particular, to an igniter assembly which includes a safety for preventing inadvertent ignition while allowing a combustible illuminant composition to be actuated by deployment of an associated parachute. Embodiments of the invention also relate to devices comprising the novel igniter assembly, such devices including, by way of example, illuminating flares.

BACKGROUND OF THE INVENTION

Among the various environments in which illuminating flares are used, perhaps the most common environment for the use of flares involves the illumination of military battle grounds. In such applications, the flares are launched above ground or water areas where enemy personnel and vehicles are suspected to be present. Essentially, the illumination provided by the flare facilitates visual detection of the enemy personnel and vehicles, providing more precise identification of target locations at which to aim ordnance. The illuminating effect provided by the flare is conventionally enhanced by equipping the flare with a parachute, which increases the flight time by slowing the rate of descent for the illuminating flare and, upon deployment thereof, provides a force for actuating an igniter housed in the flare.

The use of flares to ascertain the precise location of enemy targets can provide obvious military advantages. However, the availability and widespread use of military flares has negated this advantage somewhat, since there is an increased likelihood of opposing military forces also possessing flares. Thus, in order to gain a military advantage from the flares, it is paramount that the flares operate in a highly reliable and dependable manner, since flare failure can provide the opposing military force additional time to launch their own flares and ordnance.

An example of an illuminating flare that is reliable by conventional standards, e.g., about 87% of the time is shown in FIGS. 5-7 herein. It is believed that one of the largest contributors, if not the largest contributor, to failed firing of this illuminating flare is the misfiring of the flare igniter. The flare, which is generally designated by reference numeral 200 in FIG. 5, comprises an aluminum casing 202 partitioned into two compartments. The forward compartment is the larger of the two compartments, and contains an energetic material in the form of a solid illuminant fuel 204 designed to enhance nighttime vision and an igniter assembly 206 for initiating burning of the illuminant fuel 204. In the illustration, the aft compartment is the smaller of the two compartments, and contains a parachute 208 and a timing device (unnumbered). The timing device, inserted at an aft end of the casing 202, detaches from the flare casing 202 at a predetermined time to create a passageway through which the parachute 208 can deploy. Upon deployment through the passageway, the parachute 208 slows the rate of descent of the flare 200, extending the time during which the burning illuminant fuel 204 is maintained at an elevated position. In this manner, the illuminating effect provided by the burning illuminant fuel 204 is enhanced.

A conventional igniter is disclosed in U.S. Pat. No. 4,155,306 and illustrated in FIGS. 6 and 7 herein. Referring to FIG. 6, the igniter 206 includes a housing 212 formed of a molded piece of LEXAN® polycarbonate or other polycarbonate, or light-weight metal. The housing 212 has longitudinally extending internal walls 213 and ridge 213*a*, which are receivable into an aluminum cap (not shown). The internal walls 213 and the ridge 213 a define upper and lower hollow compartments 215, and a diametrically extending raceway 214 interposed between the upper and lower compartments 215. The raceway 214 is defined in part by the ridge 213*a* of the internal wall 213. The ridge 213*a* has a depth less than that of the remainder of the internal walls 213. For convenience, the ridge 213*a* is shaded. The function of the ridge 213*a* is explained in further detail below.

A sliding cartridge (also referred to herein as a slider) 216 is disposed in the raceway 214 and is slidable along the raceway 214. The slider 216 comprises a spring-loaded striker arm 218, a torsion spring (located at position 220), and a pistol primer (containing a small amount of explosive) 222. The striker arm 218 is depicted in a loaded or cocked position in FIG. 6. The torsion spring 220 urges the striker arm 218 to pivot about pin 224 and toward the position shown in FIG. 7, in which the striker arm 218 rests against the pistol primer 222. A cam surface 225 of the housing 212 obstructs the striker arm 218 from moving toward the pistol primer 222 and, in combination with the urging force of the spring 220, prior to actuation maintains the slider 216 in the position depicted in FIG. 6.

Located below the raceway 214 is a pellet cavity 226 containing an ignitable composition, such as boron potassium nitrate ($BKNO_3$) pellets. The pellet cavity 226 is in communication with the solid illuminant fuel 204 through an orifice (not shown).

The slider 216 is operatively connected to the parachute 208 via lanyard or cable 230, which extends along a cable raceway (not shown) formed in the aluminum casing 202. The cable 230 contains a first swage ball 232 accommodated within recess 234 for securing the cable 230 to the slider 216. The recess 234 is in communication with a slot 236, which is sufficiently wide to permit passage of the cable 230, but to obstruct passage of the first swage ball 232. At the end of the cable 230 is a second swage ball (not shown, but positioned behind the first swage ball 232 in FIG. 6). The cable 230 extends between the first swage ball 232 and the second swage ball along an axial direction, that is, perpendicular to the portion of the cable 230 passing through the slot 236 (i.e., into the sheet on which FIGS. 6 and 7 are shown). The second swage ball is encapsulated into the internal wall 213. The encapsulation of the second swage ball in the internal wall 213 serves as a safety mechanism to protect against unintentional firing by preventing tension in the cable 230 from prematurely moving the slider 216 along the raceway 214.

In operation, the igniter assembly 206 is actuated by the force generated upon parachute 208 deployment. Upon actuation of the parachute 208, the deploying parachute pulls the cable 230 toward the aft end of the flare 200. When properly operated, the force imparted on the cable 230 by the deploying parachute 208 is sufficient to dislodge the second swage ball from the housing 212 and move the slider 216 in tandem with striker arm 218 and the pistol primer 222 across the raceway 214 with sufficient force to overcome the fictional resistance between the cocked striker arm 218 and the cam surface 225, as well as the frictional resistance between the slider 216 and the raceway 214, thus passing the striker arm 218 under the cam surface 225.

After the slider 216 has moved a sufficient distance for the striker arm 218 to clear the cam surface 225, the urging force of the torsion spring 220 pivots the striker arm 218 about pin 224 and toward the pistol primer 222, which is now located over the cavity 226 containing the ignitable $BKNO_3$ pellets. Impact of striker arm 218 against the pistol primer 222 detonates the pistol primer 222. The heat and flames generated by the detonation of the pistol primer 222 pass through an orifice and ignite the $BKNO_3$ pellets in cavity 226, which in turn ignites a wafer, which in turn ignites the solid illuminant fuel 204. Because the ridge 213*a* of the internal wall 213 extends in depth only a portion of the way across the depth of the raceway 214, a clearance is defined (between the ridge 213*a* and the opposing cap surface) through which the striker arm 218 can pass as the striker arm 218 pivots toward the pistol primer 222.

Although effective by conventional standards, flares possessing the igniter assembly 206 function correctly only approximately 87% of the time. In the majority of the cases in which failure occurred, the slider mechanism 216 was found to have traveled only part of the way down the raceway, with the cable found either broken or intact. The reasons for these failures are believed to be as follows. The deployment of the parachute 208 imparts an instantaneous shock force to the cable 230, causing the second swage ball to dislodge from the slider wall in which the second swage ball is encapsulated. However, the remaining force imparted to the cable 230 by parachute deployment is not always sufficient to overcome additional frictional forces at the slider/raceway interface and the interface between the cocked striker arm 218 and the cam surface 225. These frictional forces can prevent the slider 216 from moving sufficient distance to clear the cam surface 225 and reaching and striking the pistol primer 222. One reason for the high fictional force at the slider/raceway interface is that the cable does not pull at the center of the slider 216. Another reason is that the ridge 213*a* defining the top of the raceway 214 does not extend along the full depth of the slider 216 (in order to provide a clearance for passage of striker arm 218 as the striker arm 218 pivots from the cocked state to the firing state). The presence of this clearance is believed to allow the slider 216 to rotate somewhat about its longitudinal axis in the raceway 214 during sliding movement, thus increasing fictional forces.

U.S. Pat. No. 6,412,417, the disclosure of which is incorporated by reference herein, discloses an inventive igniter assembly which overcomes at least one of the above discussed problems, for instance by reducing sticking of the slider or by providing a motion restricting bridge (replacing the encapsulated swage ball mentioned above) feature for preventing the unintentional firing and ignition of the illumination composition when subjected to a static force of up to 90 lbs. However, the igniter will be rendered inoperable if the static force required to release or break the bridge is sufficiently high enough to prevent against all inadvertent or unintentional firings, because the parachute, by way of the cable, will not provide reliable requisite force to break the bridge. Also, as the force requirement increases for the bridge, the resultant resistance force upon the cable, along its path, junctions or bends to the parachute attachment, undesirably increases.

The illumination composition ignition sensitivity for the above mentioned patent is dependent upon circumferential clocking of the igniter assembly. In this regard, the above mentioned patents due not provide against the unintended ignition of the illumination composition when the igniter assembly is subject to an impact or impulse force when dropped in a zero degree orientation, i.e., in the direction of the slider's motion.

Therefore, it is desirable to provide an igniter assembly wherein the illumination composition ignition sensitivity is substantially independent of circumferential clocking. It would also be of advantage to provide an igniter assembly that resists ignition of the illumination composition when subjected to an impact or impulse force, particularly when the force is applied generally in the zero degree orientation or in the direction of the sliders motion.

BRIEF SUMMARY OF THE INVENTION

Accordingly, in one embodiment, an igniter assembly overcoming the above-discussed problems includes a safety for preventing inadvertent ignition while allowing a combustible illuminant composition to be actuated by deployment of an associated parachute. An advantage provided by embodiments of this invention is an igniter assembly wherein the illumination composition inadvertent ignition sensitivity is substantially independent of circumferential clocking. Another advantage provided by embodiments of this invention is an igniter assembly that resists ignition of the illumination composition when subjected to an impact or impulse force, particularly when the force is applied in the zero degree orientation or in the direction of the slider's motion.

In one embodiment of the invention, a parachute flare igniter assembly includes a safety for arresting the motion of a slider when subjected to external forces, but allows slider motion when subjected to intended cable forces. The igniter safety includes a housing, a slider, a cable and a sleeve. The slider, connected to the cable, slides in a track provided in the housing allowing the slider to be slidably received therein. The cable moves the slider by applying a cable force as may be obtained by actuation of a parachute. The sleeve is connected to the cable and is disposed between the housing and the slider, the sleeve being configured and positioned to arrest the slider with respect to he housing when the cable force is not present.

In another embodiment, an apparatus for initiation of an energetic material and including an igniter assembly is provided.

In another embodiment, the invention includes a method of providing a safety in an igniter assembly.

Other advantages and features of the invention will become apparent when viewed in light of the detailed description of the various embodiments of the invention when taken in conjunction with the attached drawings and appended claims.

DETAILED DESCRIPTION OF THE INVENTION

Figure 5:
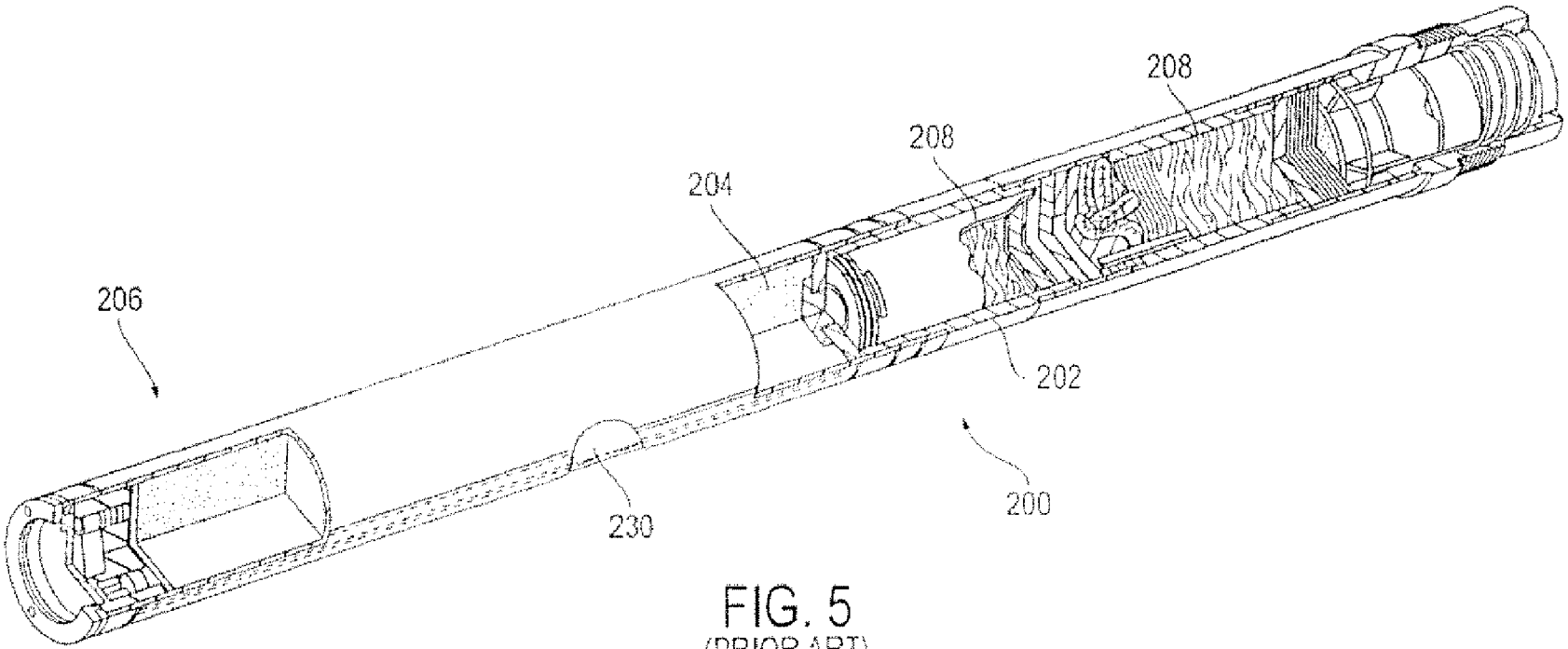
FIG. 5 (PRIOR ART)
FIG. 5 shows a partially sectioned view of a known flare in which an embodiment of the igniter assembly of the invention may be used.
Figure 6:
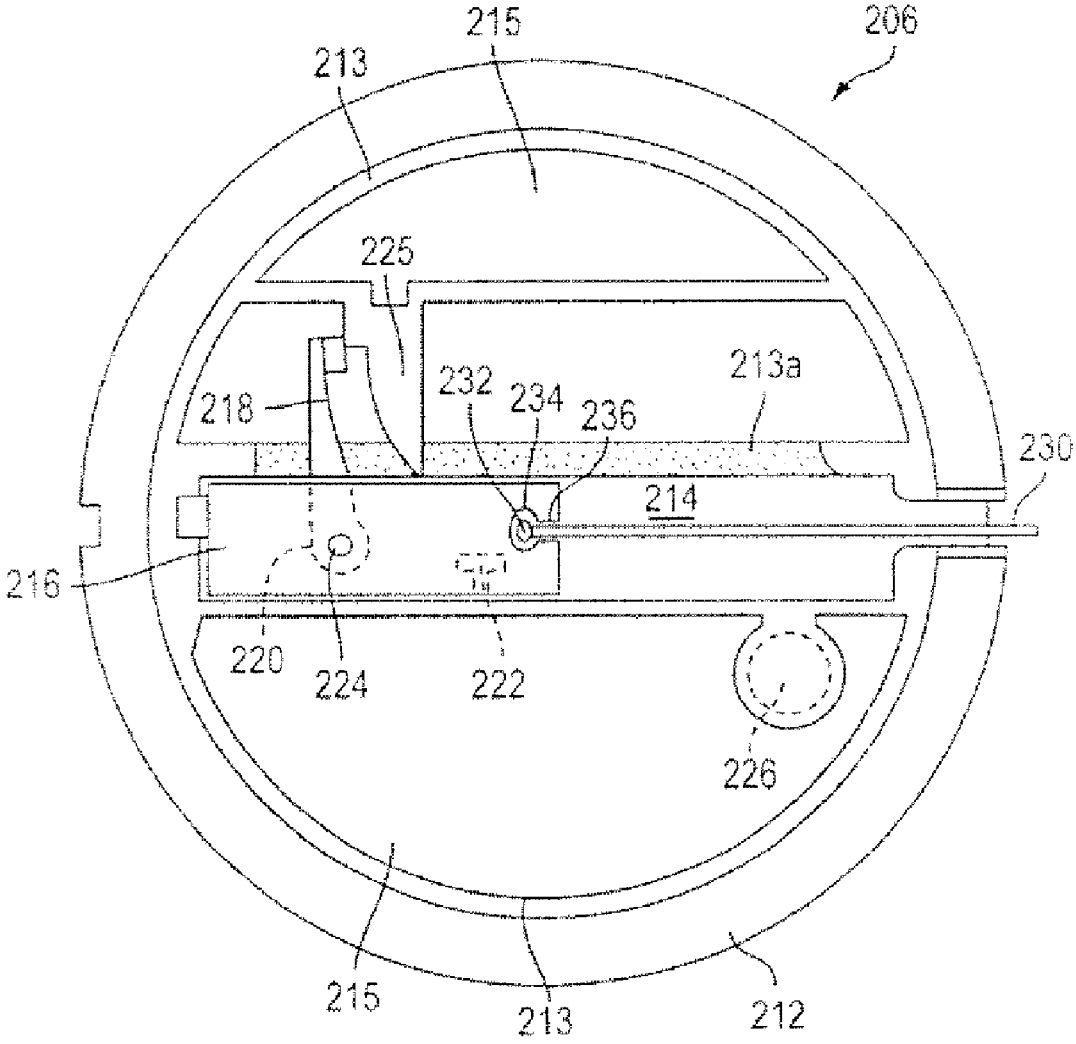
FIG. 6 (PRIOR ART)
FIG. 6 shows a plan, partially phantom view of the known igniter assembly of FIG. 5, depicting a slider and striker arm of the igniter assembly in a loaded state.
Figure 7:
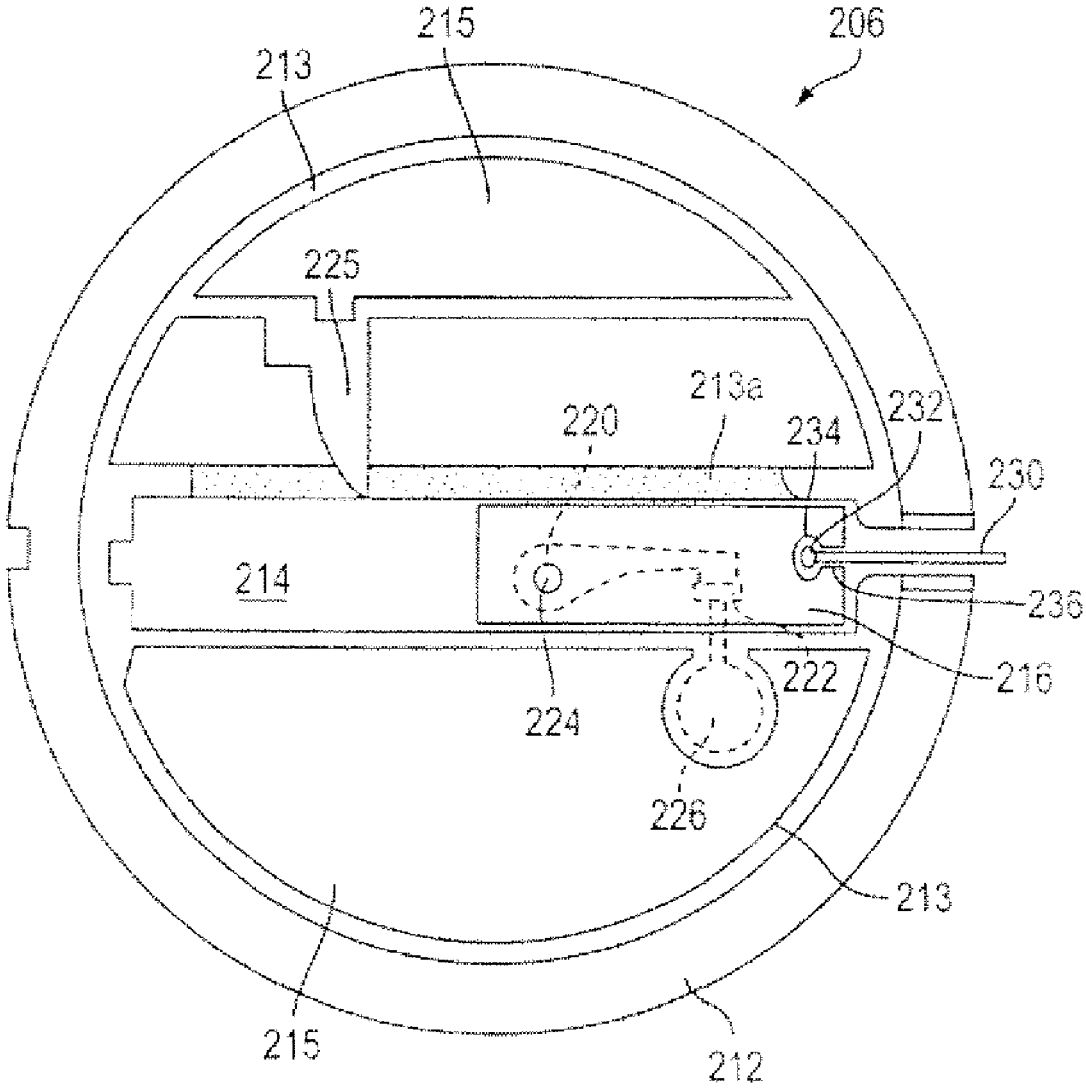
FIG. 7 (PRIOR ART)
FIG. 7 shows a plan, partially phantom view of the known igniter assembly of FIG. 6, depicting the slider and striker arm in a firing state.

An example of a basic design of the illuminating flare with which the igniter of this invention is compatible is shown in FIG. 5 and discussed above. In the interest of brevity, and because the design of known illuminating flares is within the purview of one of ordinary skill in the art, the following discussion will be limited to embodiments of the novel igniter assembly having a safe configured in accordance with the present invention.

Figure 1:
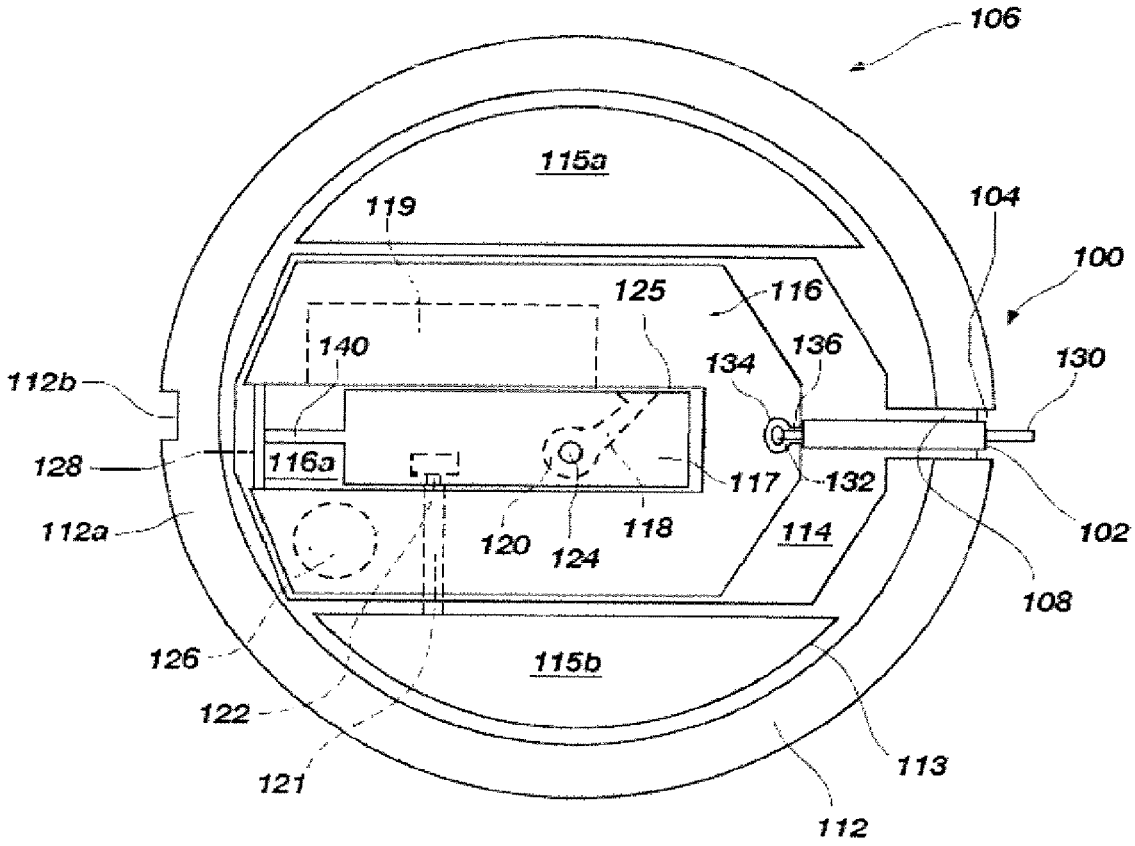
FIG. 1 shows a plan, partially phantom view of an igniter assembly having a safety in accordance with a first embodiment of the invention, depicting a slider and striker arm of the igniter assembly in a loaded state.
Figure 4:
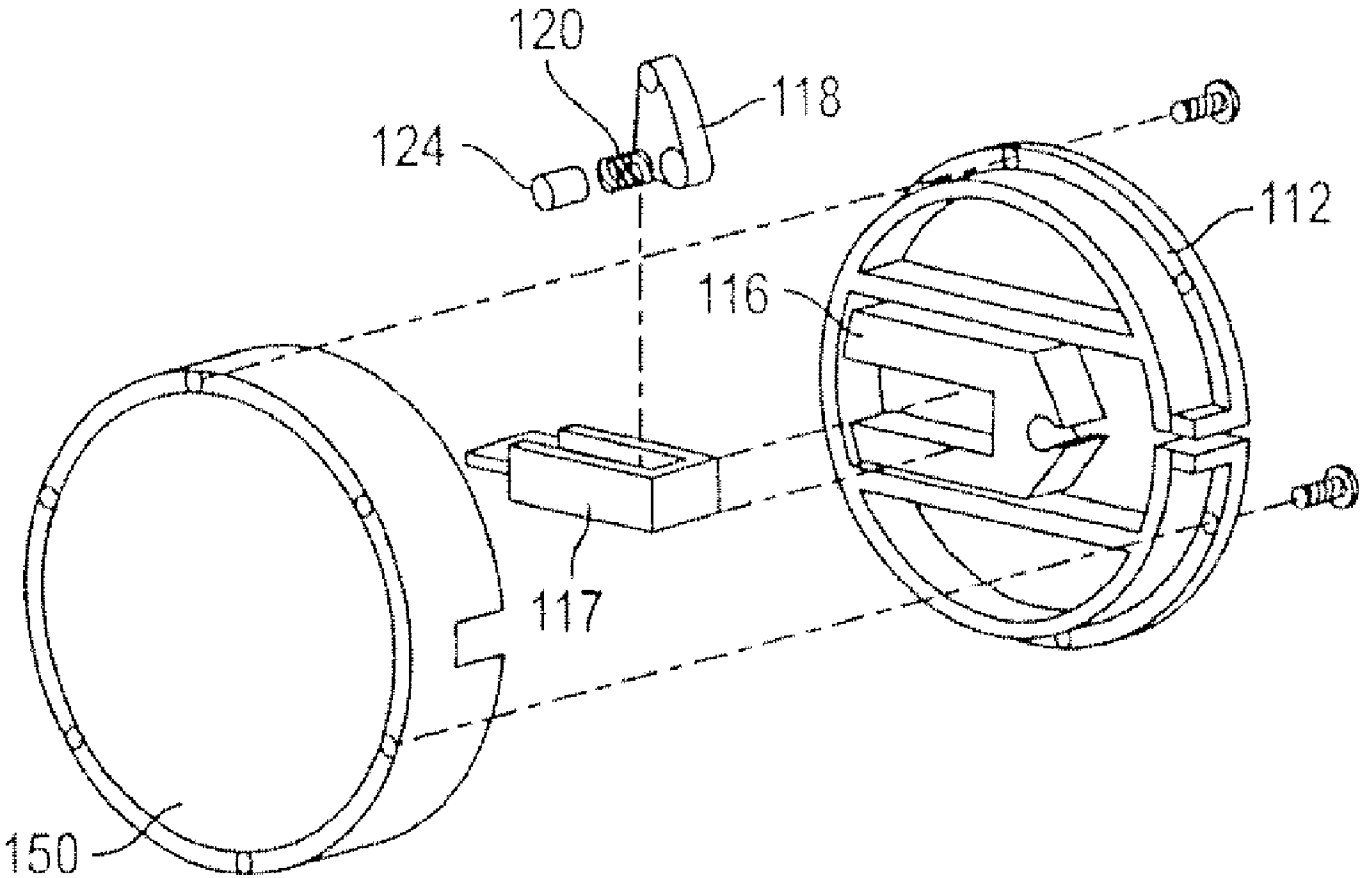
FIG. 4 shows an exploded perspective view of the igniter assembly in accordance with the first embodiment.

Referring to FIG. 1, an igniter assembly, or "igniter," 106 includes a housing 112 formed of a molded piece of LEXAN® or other polycarbonate and a safety 100. The housing 112 has longitudinally extending internal walls 113, which are receivable into an aluminum cap 150 (FIG. 4) of the casing so that peripheral portion 112*a* of the housing 112 abuts the periphery of the aluminum cap 150. Groove 112*b* may be used to assist in aligning the housing 112 and the aluminum cap 150 with the flare body. The internal walls 113 define a first hollow compartment 115*a*, a second hollow compartment 115*b*, and a diametrically extending slider raceway 114. Although the compartments 115*a* and 115*b* are optional, their presence is preferred in order to lower material costs and provide a venting feature discussed in greater detail below. A sliding mechanism (also referred to herein as a slider) 116 is disposed in the raceway 114 and is slidable along at least a portion of the raceway 114. In one embodiment, the slider 116 is sized and configured for sliding about 0.5 inch (about 1.27 cm) along the raceway 114. Each of the internal walls 113 defining the raceway 114 has a depth (perpendicular to the plane of FIG. 1) set substantially equal to the depth of the sliding mechanism 116 without impairing movement of the latter.

Figure 2:
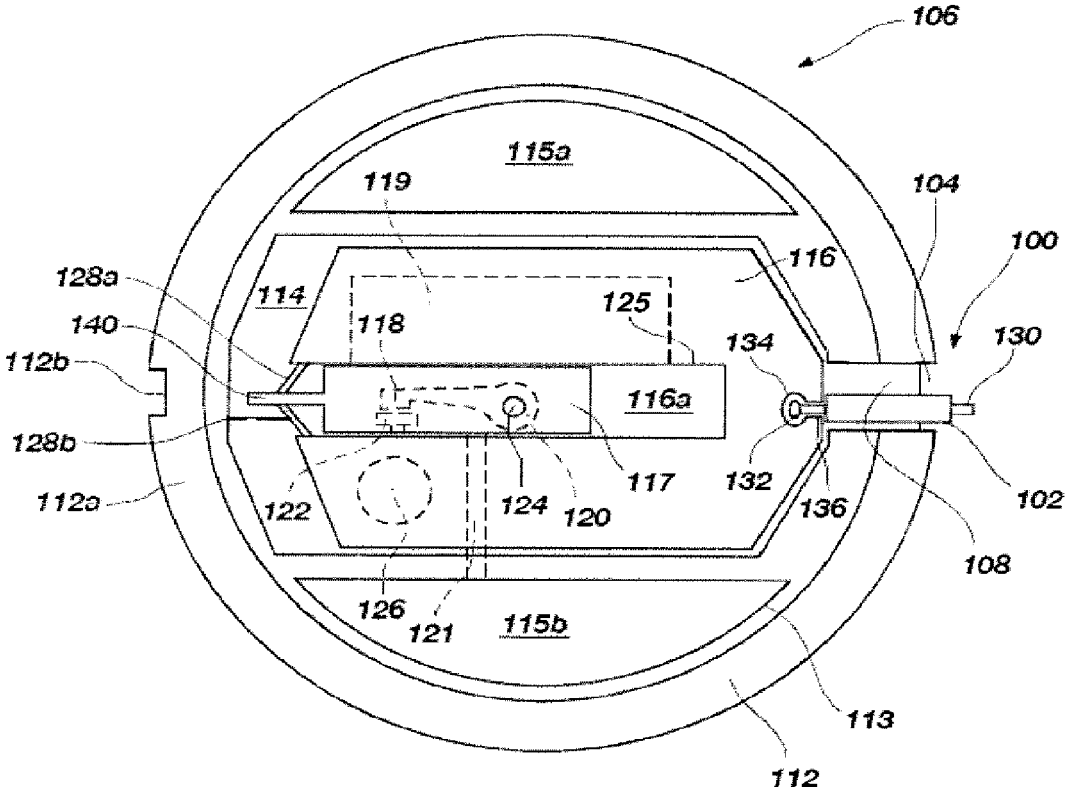
FIG. 2 shows a plan, partially phantom view of the igniter assembly of FIG. 1, but depicting the slider and striker arm in a firing state.

The slider 116 is movable between a loaded state depicted in FIG. 1 and a firing state depicted in FIG. 2. Referring to FIG. 1, the slider 116 has a pocket 116*a* substantially centrally located therein, constructed and arranged to receive a stationary cartridge 117. (Although not shown in the figures, the cartridge 117 may be provided with a pin hole and pin for retaining the striker arm 118 in the cocked position during assembly.) The slider 116 comprises a motion restricting bridge 128 positioned at an open end of the pocket 116*a*. A cutter 140 of the stationary cartridge 117 is positioned in the pocket 116*a* in contact with the motion restricting bridge 128. Although not shown, the region of the motion restricting bridge 128 contacted by the cutter 140 may include a notch to facilitate fracture of the bridge 128. When in the loaded state depicted in FIG. 1, contact between the motion restricting bridge 128 and the cutter 140 obstructs the slider 116 from sliding toward the firing position depicted in FIG. 2, unless a sufficient force is applied to the slider 116 to break the bridge 128 along cutter 140 and as concentrated thereby. The slider 116 also has incorporated therein a pellet cavity 126 and striker pin clearance slot (also referred to herein as the striker arm clearance slot) 119, the purpose of which will be explained in greater detail below. An aluminum strip (not shown) lines a portion of the pellet cavity 126 through which the explosion from a pistol primer 122 penetrates during actuation. The aluminum strip serves to protect the pellets from accidental ignition in the event that the primer material undergoes undesired ignition by means other than the striker arm. The pellet cavity 126 is movable into communication with a wafer (not shown), which is in communication with solid illuminant fuel. The pellet cavity 126 contains an ignitable composition, such as boron potassium nitrate ($BKNO_3$) pellets. In one embodiment, pellet cavity 126 is sized and configured for receiving at least eleven $BKNO_3$ pellets. (The pellets, for safety, may be loaded into the pellet cavity 126 after the igniter assembly has been assembled. Since the pellet cavity 126 moves, an oblong hole is provided in the base of the housing to allow pellet loading through the housing, as well as communication between the pellet cavity 126 and the wafer over the entire path of movement of the pellet cavity 126.) The size of the slider 116 is determined by taking into account the diameter of the pellet cavity 126 and the striker arm clearance slot 119 needed for passage of the spring-loaded striker arm 118.

Figure 8:
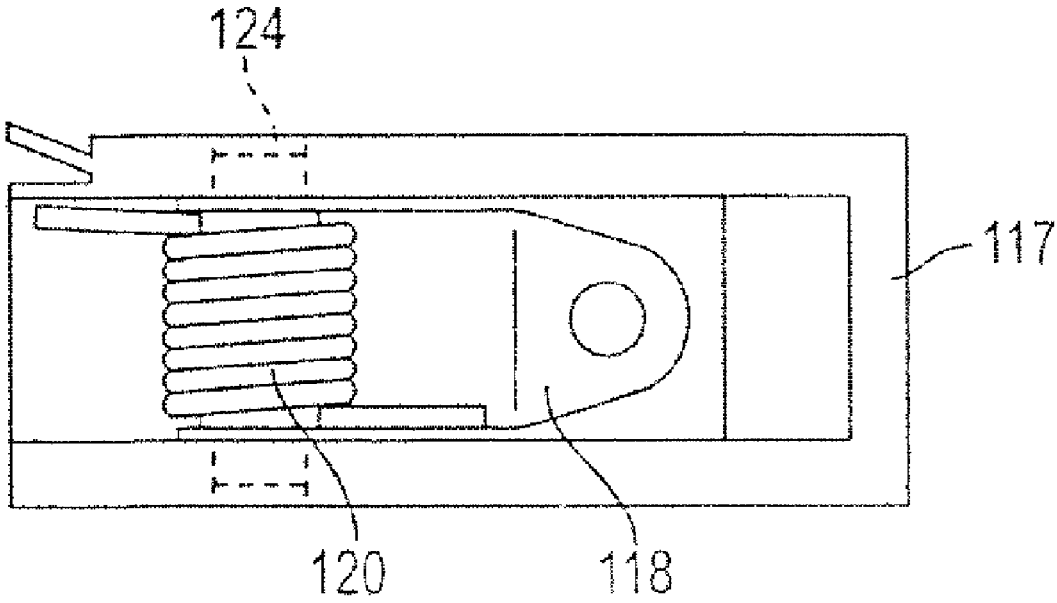
FIG. 8 shows a top plan view of a cartridge depicting the striker arm in a fired position.
Figure 9:
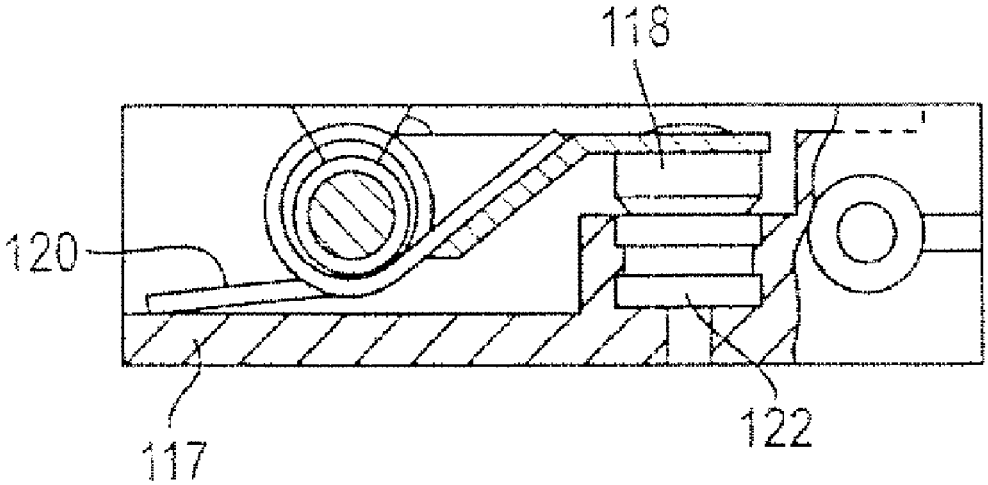
FIG. 9 shows a cross-sectional side view of the cartridge of FIG. 8.

As shown in FIGS. 8 and 9, the body of cartridge 117 is generally of a known construction and provides a mounting for the spring-loaded striker arm 118, a torsion spring 120, and the pistol primer 122. The body of cartridge 117 can be either formed separately from the housing 112 or be injection molded into the housing 112 during formation of the housing 112 so that the cartridge 117 and housing 112 are integral. The striker arm 118, the torsion spring 120, and the pistol primer 122 are then assembled in the cartridge 117. In the loaded state illustrated in FIG. 1, the torsion spring 120 urges the striker arm 118 to pivot about pin 124 toward the position shown in FIG. 2 in which the striker arm 118 is seated against the pistol primer 122. However, when the slider 116 is in the loaded state, a cocking wall portion 124 of the slider 116 obstructs the striker arm 118 from moving from its cocked position toward the pistol primer 122.

The slider 116 is operatively connected to the parachute via cable (or lanyard) 130, which extends through a cable slot 104 and along an axial channel (not shown) contained in the flare body. The cable 130 is attached to the slider 116 via a swage ball 132, which is accommodated within recess 134 of the slider 116 for securing the cable 130 to the slider 116. The recess 134 is in communication with a slider slot 136, which is sufficiently wide to permit passage of the cable 130, but sufficiently narrow to obstruct passage of the swage ball 132 therethrough. The cable 130 may be aligned with the longitudinal axis (center) of the slider 116. Instead of using a roller pin to redirect the cable 130 near the end of the flare, a LEXAN® or other polycarbonate molded surface 108 having a relatively large radius can be used to redirect the cable 130 from along the cable slot 104 (shown extending to the right in FIG. 1, but when the aluminum cap 150 is connected onto the housing 112 the cable 130 extends through and along the cable slot 104, i.e. into the drawing figure) and toward the longitudinal axis of the slider 116. Enlarging of the turn radius for cable redirection reduces the friction upon the cable 130.

The safety 100 includes, by way of example, an aluminum sleeve 102 selectively coupled to the cable as shown in FIG. 1. The sleeve 102 may comprise a draw, round 3003 aluminum tube having a wall thickness of 0.040 inch. When the aluminum cap 150 is assembled to the housing 112, the cable 130 is directed through the cable slot 104 such that the ends of the sleeve 102 provide a mechanical lock-out between the slider 116 and the inside wall (not shown) of the aluminum cap 150, which will be discussed below in greater detail in the second embodiment of the invention. This mechanical lock-out or safety 100 substantially eliminates the possibility of accidental illumination composition ignition by providing the sleeve 102 cooperatively associated with the cable 130 to minimize movement of the slider 116 when subjected only to accidental shock or impulse force, such as would be experienced by dropping the igniter 106.

The sleeve 102 is designed to provide a comparatively rigid material structure in its axial, longitudinal direction and further includes either a designed "soft" structure, a relatively weak material structure, a brittle material structure or a combination of such features in a normal or radial direction to the longitudinal axis of the sleeve. The material structure of the sleeve 102 in the axial direction, parallel to cable 130 as sleeve 102 is initially disposed in igniter assembly 106 is sufficiently strong under columnar loading so as to prevent slider movement in the event of an accidentally applied force. Moreover, the material structure of the sleeve 102 in the normal, i.e., radial, direction is designed to cause the sleeve 102 to bend, break, comply or yield when subjected to a sufficient yet relatively small lateral force, such as when the parachute pulls upon the cable 130 via the cable slot 104. By providing the designed material and/or structural characteristics into the sleeve 102, the sleeve 102 may rigidly support the cable 130 when subjected to accidental loadings to provide a mechanical lock-out of slider movement, but will allow the cable to give or bend when subjected to intended loadings, allowing slider movement.

As noted above, the sleeve 102 in this embodiment is a round aluminum tube having an axial, drawn hole therethrough for selectably and positionably receiving the cable 130. The wall thickness of the sleeve 102 is sufficiently thin to provide the designed "soft" structure as described herein without impairing its functionality under axial loading. It is recognized that other shapes may be used to advantage, particularly a square sleeve, without limitation. Moreover, the sleeve 102 may be made out of other materials compatible with the above-mentioned design characteristics, including for example, without limitation, glass, ceramic, wood, plastic and other metals and alloys. Optionally, the sleeve 102 may be integral with or form an integral part of the cable 130, instead of being a separate component. Also, the sleeve 102 may be permanently secured to the cable 130, as by crimping, and need not necessarily allow the cable to slide to any substantial degree therein.

In operation, the igniter 106 is actuated by the force generated upon parachute deployment. Upon actuation of the parachute, the cable 130 is pulled by the deploying parachute. When properly operated, the force imparted on the cable 130 by the deploying parachute is sufficient to cause the cable 130 to pull through the cable slot 104 and apply a small fracture force (normal or radial force) sufficient to bend, break, comply or yield the sleeve 102, disabling the mechanical lock-out, or safety 100. With the disabling of the safety 100, the cable 130 pulls the slider 116 from its loaded state to its firing state while simultaneously breaking the optional motion restricting bridge 128 along the cutter 140. After the bridge 128 has been broken, bridge segments (designated by reference numerals 128*a* and 128*b* in FIG. 2) flare over the cutter 140 and keep the slider 116 from moving backwards (i.e., toward its loaded state position). The cutter 140 is preferably designed with a small radius on the tip rather than a sharp edge, so that over time the edge of the cutter 140 will not wear through the bridge 128 due to normal vibrations experienced during transportation of the flare. It is recognized that the optional bridge provides resistance to slider motion or cable tension. However, the optional bridge is not designed to mechanically lock-out the sliders motion when subjected to an impact force primarily directed in the zero degree orientation of the igniter assembly. Table 1 provides an acceptance table for a slider when subjected to an as indicated force (the first row assesses the conventional igniter assembly not having the safety according to an embodiment of the invention, the second through fourth rows assess the inventive igniter assembly having the inventive safety).

TABLE 1

| Force | Intended Slider Motion | Lock-out | Acceptable |
|---|---|---|---|
| No sleeve with applied axial impact force (conventional condition including a bridge) | No | No | No |
| Sleeve with applied axial impact force, i.e., a force applied in the zero degree direction | No | Yes | Yes |
| Sleeve with applied cable force, i.e., a force applied by actuation of a parachute | Yes | No | Yes |
| Sleeve with simultaneously applied cable force and axial impact force | Yes | No | Yes |

Figure 3:
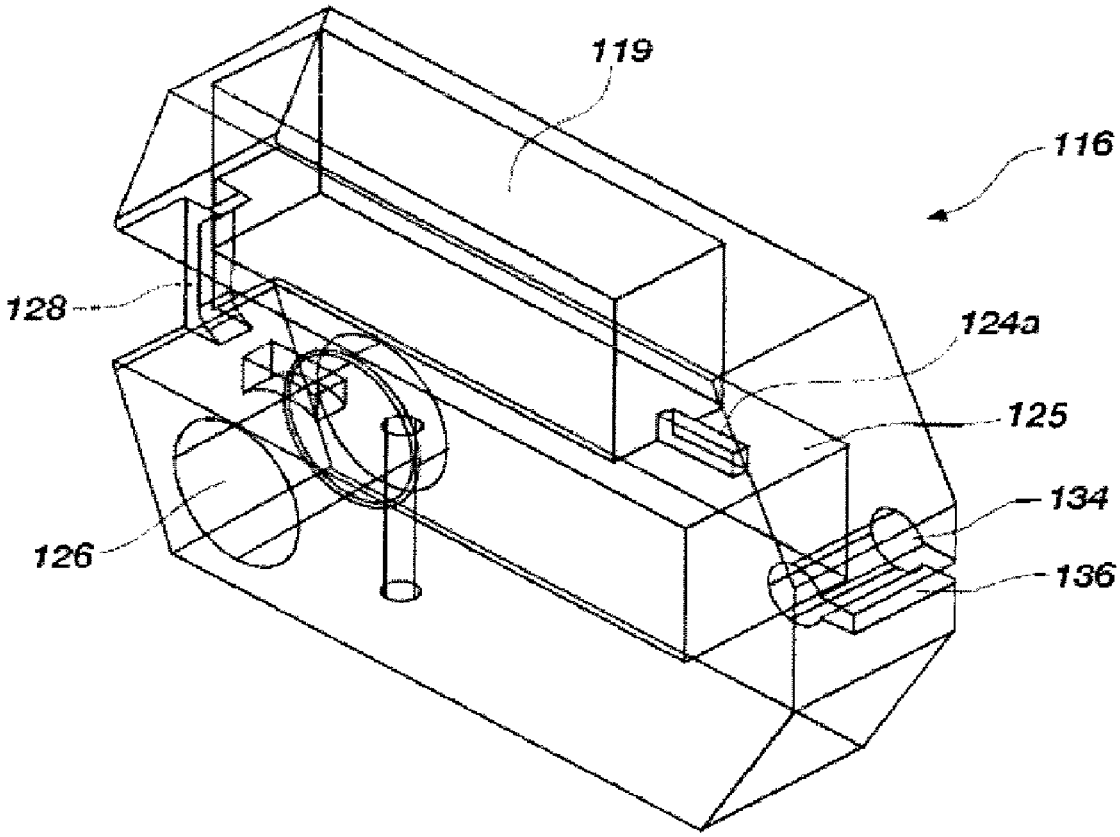
FIG. 3 shows an isolated, perspective view of the slider of the igniter assembly in accordance with the first embodiment.

Movement of the slider 116 into the firing state depicted in FIG. 2 moves the striker arm 118 out of contact with cocking wall portion 124 and aligns the striker arm 118 with striker pin clearance slot 119. As shown in FIG. 3, the cocking wall portion 124 can contain a guide slot 124*a* for receiving the striker pin (unnumbered) at the distal end of the striker arm 118. Provision of this guide slot 124*a* prevents the tip of the striker pin from becoming embedded in the wall portion 124, thus further enhancing the reliability of the igniter. The striker arm 118 is hence permitted to move through the striker pin clearance slot 119 (due to the urging force imparted by the torsion spring 120) until the striker arm 118 strikes against the pistol primer 122.

Movement of the slider 116 into the firing state depicted in FIG. 2 also moves the pellet cavity 126 to align the pellet cavity 126 with pistol primer 122. Thus, detonation of the pistol primer 122 starts an ignition sequence by which the $BKNO_3$ pellets, the wafer, and the illuminant composition are sequentially ignited.

Optionally, the bridge 128 provides a variable safety feature for controlling the force required to move the slider 116. The stress on the bridge 128 is equal to force over area. By increasing the height of the bridge 128, more stress is required to break the bridge 128. In one embodiment, the bridge 128 height was set at about 0.0305 cm (0.12 inch) to 0.356 cm (0.14 inch) to prevent backward movement of the slider 116 and provide a minimum pull force requirement of at least 50 lbs force and, more preferably, 90 lbs force to move the slider 116 into the firing state shown in FIG. 2. As mentioned above, the bridge 128 can be provided with a notch to facilitate fracture of the bridge 128 with cutter 140. However, while the bridge 128 provides a resistance force, it fails to provide the necessary lock-out or other preventative measures to insure against inadvertent ignition, or movement of the slider 116 causing ignition. While the bridge 128 is not necessarily required, it may be included not only to provide the aforementioned minimum pull force requirement but also to facilitate assembly of the cocked striker arm 118 by holding the slider 116 in its cocked or loaded position.

Another optional safety feature is the provision of one or more holes 121 through the portions of the internal walls 113 defining the raceway 114 so that, if by some mishap the pistol primer 122 were to unintentionally ignite before the slider 116 is moved to its firing state, the gases generated by ignition of the pistol primer 122 can be vented to one or both of the outside compartments 115*a* and 115*b* to prevent ignition of the $BKNO_3$ pellets.

Material selections for the igniter assembly parts, not mentioned herein, are considered to be well understood by a person of ordinary skill in the art and thus further mention is not necessary.

Representative infrared illuminating compositions that may be used with embodiments of this invention are disclosed in U.S. Pat. Nos. 3,411,963, 5,056,435, 5,587,522, 5,912,430, and 6,123,789, the disclosures of each of which are incorporated herein by reference.

Parachute deployment systems and conventional flare assemblies modifiable for use with embodiments of the igniter of this invention are disclosed in U.S. Pat. Nos. 5,386,781 and 5,347,931, the disclosures of each of which are incorporated herein by reference.

Having described an embodiment of an igniter assembly above including an embodiment of the inventive safety, attention will now be turned primarily to other embodiments of the inventive safety with further discussion of the igniter assembly and its operation only as desirable to facilitate a more comprehensive understanding and appreciation of the invention. A second embodiment of the invention is shown in FIGS. 10, 11 and 12 and described with respect thereto.

Figure 10:
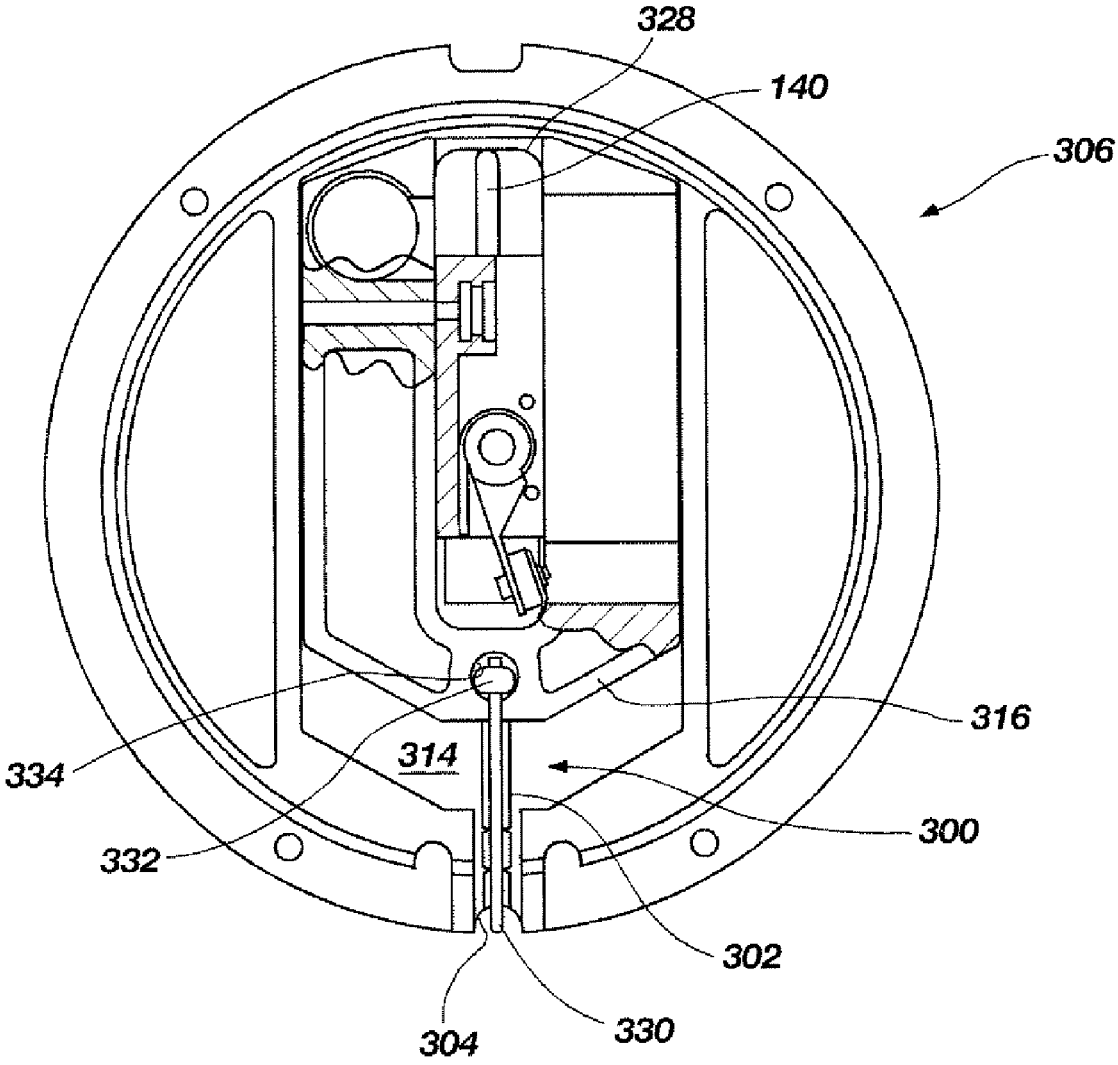
FIG. 10 shows a plan, partially sectioned view of an igniter assembly having a safety in accordance with a second embodiment of the invention.

FIG. 10 shows a plan, partially sectioned view of an embodiment of an igniter assembly 306 having a safety 300 in accordance with a second embodiment of the invention. Reference may be simultaneously made to FIGS. 11 and 12. The igniter assembly 306 includes a slider 316 that is sized and configured for travel along a slider pathway 314 within a housing 312 when properly urged by a cord or cable 330, the cable 330 having an end cap 332 and inserted into a channel 334 of the slider 316 as similarly described above. It is recognized that the cable 330 may be permanently affixed or connected to the slider 316 as would be recognized by a person having ordinary skill in the relevant art. The igniter assembly 306 further provides an optional, arcuate shaped bridge 328 for retaining the slider 316 in the loaded state upon a cutter 140, where the cutter 140 may pierce or release the bridge 328 allowing the slider 316 to travel along the pathway 314 into the firing state. The bridge 328 provides some resistance to slider motion; however, it does not provide assurance of unintended motion when subjected to all external forces, as was described above, e.g., first row in Table 1.

In order to prevent unintended slider motion accidental application of force, the igniter assembly 306 includes the safety 300. Generally, the safety 300 provides a lock-out type of mechanism that prevents slider motion except when a particular "combination" of parameters is provided that allows the slider 316 to move as intended. Specifically, the so called "combination" is acquired by taking advantage of the material properties, the material geometry, the intended cable force and the unintended impact force. The required parameter combination is such that when there is a cable force the material geometry and the material properties will allow slider motion, but when the unintended impact force is present without the cable force then there is no slider motion. The impact force FI comprises generally any external force being applied to the igniter assembly 306 in any direction, particularly in the zero-degree direction as shown in FIG. 11. The cable force FC is the force applied to the cable 330 in a cable channel 304 when actuated by the deploying parachute. The cable force FC is generally shown in FIGS. 11 and 12. The cable channel 304 directs the cable force FC somewhat orthogonally to the travel direction of the slider 316, however it is recognized that the cable force FC may be oriented in any direction other than inline with the slider's motion and the impact force FI.

Figure 11:
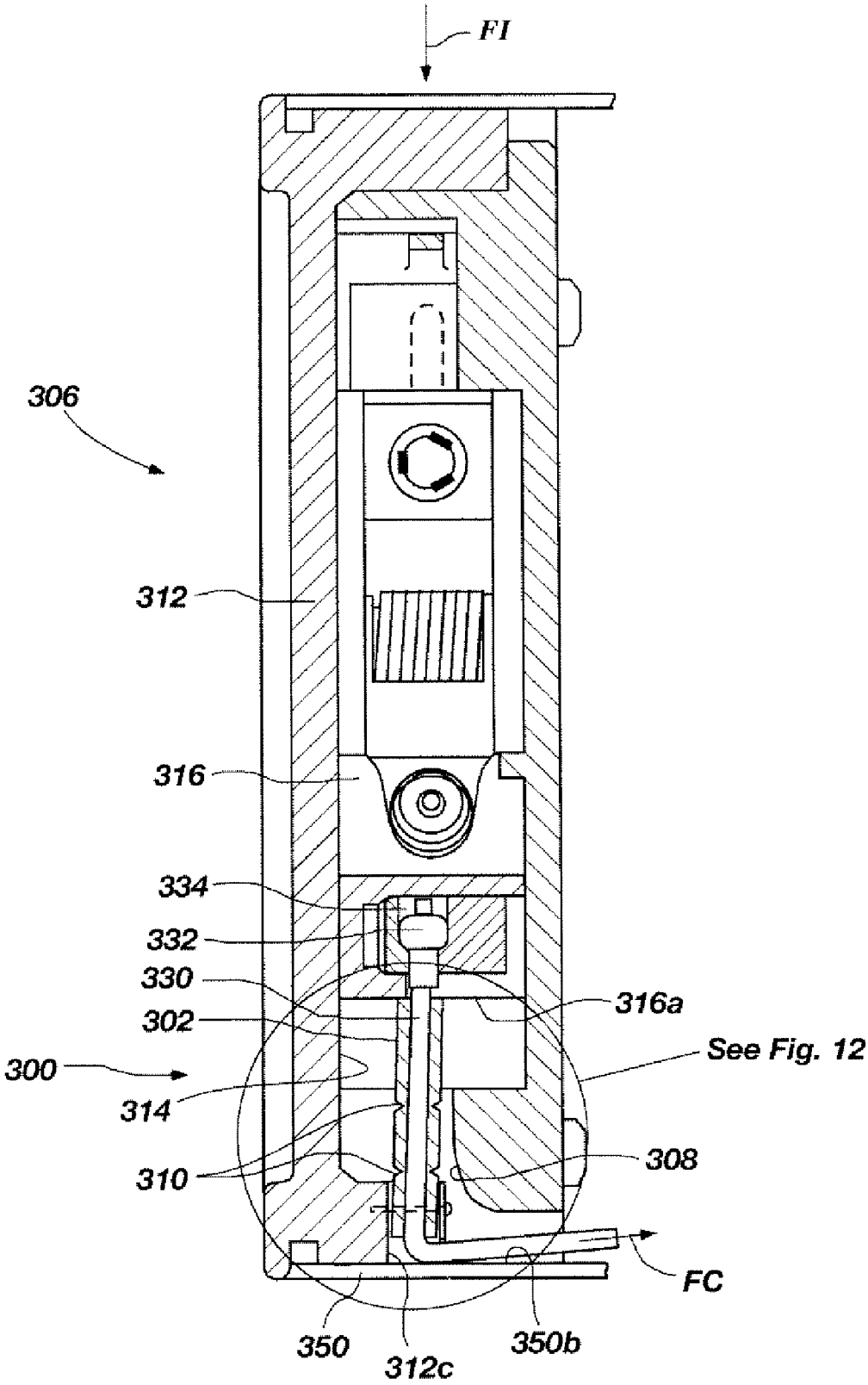
FIG. 11 shows a cross-sectional side view of the igniter assembly in accordance with the second embodiment.
Figure 12:
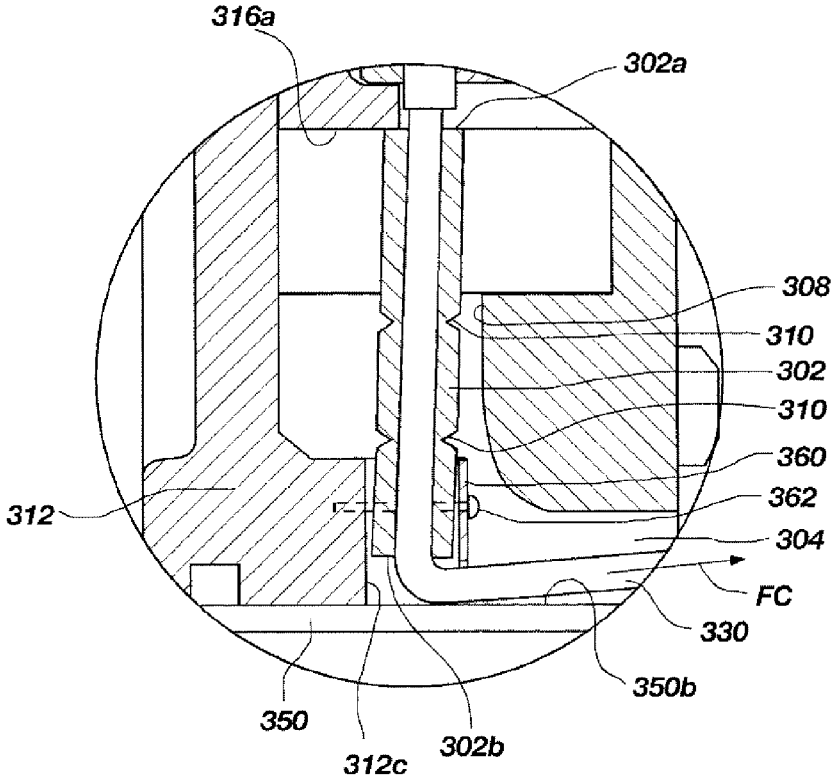
FIG. 12 shows a partial cross-sectional view of the safety in accordance with the second embodiment.

Returning to the embodiment shown in FIGS. 11 and 12, the safety 300 includes a cable 330 connected to a sleeve 302, where the sleeve 302 arrests the motion of the slider 316 with respect to the igniter assembly 306 when subjected to the impact force FI by acting as a supporting column. The sleeve 302 has a slider end 302*a* and a housing end 302*b*. The sleeve 302 provides structural support for the cable 330 primarily in its axial direction so that proximately coupled ends 302*a* and 302*b* provide motion resistance between a slider end 316*a* of the slider 316 and (including an intervening segment of cable 330) an inside housing cover surface 350*b* of a housing cap or cover 350, respectively. The cover 350 is part of the igniter assembly 306.

The sleeve 302 is sufficiently pliable that it may fracture, bend, flex, yield or otherwise give way when subjected to the cable force FC applied by the cable 330, allowing the slider 316 to move as the cable 330 is drawn through the cable channel 304. In this embodiment the cable channel 304 orthogonally transitions the motion of cable 330 to the direction of movement of slider 316. To further facilitate designed failure of the sleeve 302 when subjected to the cable force FC, an impingement surface or point 308 is provided in the cable channel 304 of the igniter assembly 306.

The sleeve 302 may include one or more peripheral recesses or grooves 310. The grooves 310 provide added structural relief in the non-axial direction for facilitating motion of the cable 330 when subjected to cable force FC, without appreciably diminishing the strength of the sleeve 302 in its axial direction when subjected to impact force FI. The grooves 310 in this embodiment are v-grooves; however, it is recognized that any other suitable shape, including without limitation slits, cuts or material fracture points, that facilitate relief may be used.

In order to provide vibration protection to the sleeve 302 during storage and handling and to further secure the sleeve 302 between the slider 316 and the cover 350, an optional sleeve bridge 360 may be included. The sleeve bridge 360 releasably secures the sleeve 302 (and the cable 330) to a wall 312*c* of the housing 312 with tacks 362. The sleeve bridge 360, the tacks 362 or a combination of the two are designed to give way allowing the cable 330 and sleeve 302 to propagate through the cable channel 304 when subject to the cable force FC.

As described above with respect to the second embodiment, there are design attributes that improve the functionality of the sleeve 302. The sleeve 302 may be "staked" into place to retain the sleeve within the assembly, but yet allow sleeve 302 movement upon a load applied through the cable 330. Also, the polycarbonate housing 312 may have a radius having a very subtle, yet sharpened, corner within the assembly to further ensure the sleeve 302 or sleeve segments will fracture upon cable loading. Moreover, the polycarbonate housing 312 opening may be sized to allow the "fractured" sleeve to pass through the igniter assembly into cable channel 304, providing additional space for slider or sleeve movement. Moreover, the sleeve 302 may include a plurality of "v" grooves in the wall thereof to a sufficient depth, given the sleeve wall thickness, to facilitate sleeve fracture upon cable loading.

To summarize with respect to the described embodiments, embodiments of the sleeve are designed, with geometry and material selection, to stay in place, until sufficient and appropriately directed force releases the sleeve allowing for slider movement and flare ignition. Thus, the flare may ignite when operational loads are applied through a cable, but will resist flare ignition due to other loads applied to the flare.

Figure 13:
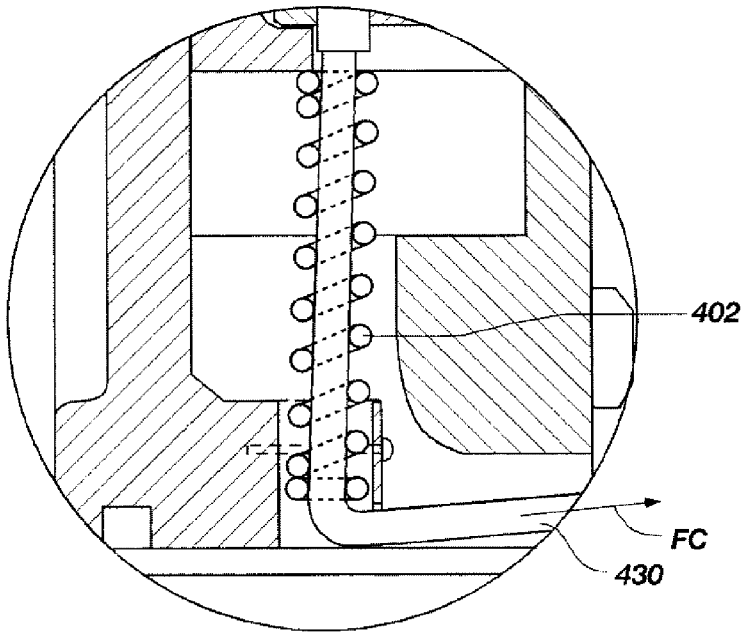
FIG. 13 shows a partial cross-sectional view of a sleeve suitable for use with a safety in accordance with a third embodiment of the invention.

A third embodiment of a sleeve 402, as depicted in FIG. 13, is a coil bound or tension spring. The coil bound or tension spring may surround a cable 430 in the same manner as mentioned above with respect to the first and second embodiments to provide high stiffness in the axial direction of the sleeve 402 under columnar loading, but while allowing the cable 430 to yield in the normal direction. In this regard, the spring forming sleeve 402 would have high spring rate K to resist external forces, but a low bending moment to allow the cable 430 to apply a cable force.

While particular embodiments of the invention have been shown and described, numerous variations and other embodiments will readily occur to those of ordinary skill in the art. Accordingly, the invention is limited only by the appended claims.

What is claimed is:

1. An igniter safety for an igniter assembly comprising:

a housing;

a slider slideably disposed in a track provided in the housing;

a cable operably coupled proximate an end thereof to the slider for applying force thereto to effect sliding motion thereof within the housing; and a sleeve coupled to the cable and disposed between the housing and the slider, the sleeve being configured to arrest motion of the slider with respect to the housing under forces applied to the slider other than through the cable.

2. The igniter safety of claim 1, wherein the housing further includes a cap and the sleeve is disposed between the cap and the slider.

3. The igniter safety of claim 1, wherein the cable is operably coupled at another end to a parachute for providing the force to effect the sliding motion of the slider responsive to deployment of the parachute.

4. The igniter safety of claim 1, wherein the slider is slidably disposed for movement in a first direction and the housing includes a channel at least partially oriented in a second direction substantially orthogonal to the first direction, the cable extending from the slider and into a portion of the channel oriented in the second direction.

5. The igniter safety of claim 4, further comprising at least one sleeve impingement location on a side of the channel proximate an initiation point of the portion of the channel oriented in the second direction.

6. The igniter safety of claim 1, wherein the sleeve is structured to at least one of bend, fracture and deform in response to force applied substantially transverse to a longitudinal axis of the sleeve.

7. The igniter safety of claim 6, further comprising a sleeve impingement point in a channel of the housing through which a portion of the cable extends to facilitate the at least one of bending, fracture and deformation of the sleeve by contact therewith under the force applied substantially transverse to the longitudinal axis of the sleeve.

8. The igniter safety of claim 1, wherein the sleeve is affixed to the cable against substantial longitudinal movement.

9. The igniter safety of claim 1, wherein the sleeve is substantially cylindrical.

10. The igniter safety of claim 1, wherein the sleeve includes at least one relief thereon.

11. The igniter safety of claim 10, wherein the at least one relief comprises a groove.

12. The igniter safety of claim 1, wherein the sleeve comprises a thin walled aluminum conduit.

13. The igniter safety of claim 1, wherein the sleeve comprises a coil spring.

14. The igniter safety of claim 1, further including a sleeve bridge securing the sleeve to a wall of the housing subject to release responsive to application of force through the cable.

15. The apparatus of claim 14, wherein the slider is slidably disposed for movement in a first direction and the housing includes a channel at least partially oriented in a second direction substantially orthogonal to the first direction, the cable extending from the slider and into a portion of the channel oriented in the second direction.

16. The apparatus of claim 15, further comprising at least one sleeve impingement location on a side of the channel proximate an initiation point of the portion of the channel oriented in the second direction.

17. An apparatus for initiation of an energetic material, the apparatus including an igniter assembly comprising:

a housing including internal walls defining a raceway;

a cartridge disposed in the raceway and retained in a stationary state relative to the housing, the cartridge comprising a stationary primer and a spring;

a striker arm connected to the cartridge and the spring and movable into a cocked state in which the spring urges the striker arm toward the primer;

a cable;

a slider disposed in the raceway and operably coupled to an end of the cable, the slider comprising an igniter composition chamber having an igniter composition therein and a cocking wall portion, the slider being movable along at least a portion of the length of the raceway from a loaded position in which the striker arm is maintained in the cocked state by contact with the cocking wall portion to a firing position in which the igniter composition chamber is aligned and in communication with the primer and the striker arm is free of the cocking wall portion to permit the spring to drive the striker arm from the cocked state into the primer; and a sleeve coupled to the cable and disposed between the housing and the slider, the sleeve being configured to arrest motion of the slider within the raceway under forces applied to the slider other than through the cable.

18. The apparatus of claim 17, wherein the cable is operably coupled at another end to a parachute for providing the force to effect the sliding motion of the slider responsive to deployment of the parachute.

19. The apparatus of claim 17, wherein the igniter composition comprises a plurality of $BKNO_3$ pellets.

20. The apparatus of claim 17, wherein the housing further includes a cap and the sleeve is disposed between the cap and the slider.

21. The apparatus of claim 17, wherein the sleeve is structured to at least one of bend, fracture and deform in response to force applied substantially transverse to a longitudinal axis of the sleeve when the cable force is applied.

22. The apparatus of claim 21, further comprising a sleeve impingement point in a channel of the housing through which a portion of the cable extends to further facilitate the at least one of bending, fracture and deformation of the sleeve by contact therewith under the force applied substantially transverse to the longitudinal axis of the sleeve.

23. The apparatus of claim 17, wherein the sleeve is permanently affixed to the cable against substantial longitudinal movement.

24. The apparatus of claim 17, wherein the sleeve is substantially cylindrical.

25. The apparatus of claim 17, wherein the sleeve includes at least one relief thereon.

26. The apparatus of claim 17, wherein the at least one relief comprises a groove.

27. The apparatus of claim 17, wherein the sleeve comprises a thin walled aluminum conduit.

28. The apparatus of claim 17, wherein the sleeve comprises a coil spring.

29. The apparatus of claim 17, further including a sleeve bridge, the sleeve bridge securing the sleeve to a wall of the housing subject to release responsive to application of force through the cable.

30. The apparatus of claim 17, wherein the cartridge further comprises a cutter and wherein the slider further comprises a motion restricting bridge contacting the cutter and restricting movement of the slider between the loaded and firing positions, the motion restricting bridge configured to fracture responsive to contact with the cutter and permit movement of the slider in the raceway responsive to sufficient force applied through the cable.

31. A method of providing a safety in an igniter assembly comprising:

providing a housing having a raceway therein;

disposing a sleeve on a cable;

attaching an end of a cable to a slider and disposing the slider in the raceway; and locating the sleeve on the cable between the slider and a surface of the housing to prevent movement of the slider in the raceway under loading substantially in line with a longitudinal axis of the sleeve.

32. The method of claim 31, further comprising permitting movement of the slider responsive to force applied through the cable by loading the sleeve in a direction substantially transverse to the longitudinal axis and causing the sleeve to structurally fail.

* * * * *